United States Patent [19]

Eng

[11] 4,040,919

[45] Aug. 9, 1977

[54] VOLTAGE REDUCTION OF MEMBRANE CELL FOR THE ELECTROLYSIS OF BRINE

[75] Inventor: Jeffrey D. Eng, N. Vancouver, Canada

[73] Assignee: Hooker Chemicals & Plastics Corporation, Niagara Falls, N.Y.

[21] Appl. No.: 657,134

[22] Filed: Feb. 11, 1976

Related U.S. Application Data

[63] Continuation of Ser. No. 518,903, Oct. 29, 1974, abandoned.

[51] Int. Cl.[2] ..... C25B 1/16; C25B 1/26; C25B 13/00

[52] U.S. Cl. ..... 204/98; 204/128; 204/196

[58] Field of Search ..... 204/98, 128, 296, 196

[56] References Cited

U.S. PATENT DOCUMENTS

| | | | |
|---|---|---|---|
| 1,309,214 | 7/1919 | Moore | 204/295 |
| 2,967,807 | 1/1961 | Osborne et al. | 204/98 |
| 3,220,941 | 11/1965 | Osborne | 204/98 |
| 3,222,267 | 12/1965 | Tirrell et al. | 204/98 |
| 3,467,586 | 9/1969 | Grotheer et al. | 204/98 |
| 3,630,863 | 12/1971 | Jeffery et al. | 204/296 |
| 3,773,634 | 11/1973 | Stacey et al. | 204/98 |

*Primary Examiner*—R. L. Andrews

*Attorney, Agent, or Firm*—Peter F. Casella; Herbert W. Mylius

[57] ABSTRACT

The voltage drop in a three compartment membrane cell used for the electrolysis of brine is diminished by treatment of the anolyte with acid, preferably hydrochloric acid, lowering the caustic concentration in the buffer zone and decreasing the current density for a period of time, during which the membrane adjacent to the anolyte is rejuvenated, and then resuming normal operations. In a similar manner the voltage drop in a two compartment membrane cell may be reduced, with the lowering of the caustic concentration being effected in the catholyte, preferably by dilution with water.

9 Claims, 3 Drawing Figures

VOLTAGE REDUCTION OF MEMBRANE CELL FOR THE ELECTROLYSIS OF BRINE

This is a continuation of application Ser. No. 518,903, filed Oct. 29, 1974 now abandoned.

This invention relates to reducing the voltage across a membrane cell employed for the electrolysis of brine. More particularly, it relates to rejuvenating membranes of two compartment and three compartment electrolytic membrane cells to decrease the cell voltage drop required for electrolysis.

Diaphragm-type electrolytic cells employed for the electrolysis of brine solutions tend to have the diaphragms thereof become plugged or objectionably coated with deposits during electrolysis. Such deposits, which have been considered to result from impurities in the feeds to the cell, tend to block passageways for liquid and ionic flows through the usual asbestos diaphragms employed. The result is a greater voltage drop required to effect desired electrolysis, with a corresponding increase in the amount of power consumed during electrolysis. Especially today when power is in short supply it is important to conserve it. Accordingly, diaphragm cells are sometimes treated with a more acidic medium than the electrolyte, so as to help to remove such high resistance deposits and improve the conduction of electricity and the passage of electrolyte ions through the diaphragm.

Membrane cells have recently been used experimentally and commercially for the manufacture of chlorine and caustic from brine. In such cells membranes, preferably cation-active permselective membranes, separate anolyte and catholyte and in some cases bound a buffer compartment between the anode compartment and the cathode compartment. It has now been discovered that although the materials of the membranes are chemically and physically very different from those of the normal asbestos diaphragms used in diaphragm cells, during continued operation the voltage drop across the membrane cell also increases, leading to higher power consumption. Apparently this is due to production of an insulating coating on the membrane. It has now been discovered that such coating can be removed and the membrane can be rejuvenated by the invented process.

In accordance with the present invention a method of lowering the voltage drop in a membrane cell for the electrolysis of brine comprises acidifying the anolyte, diluting other electrolyte in contact with a membrane which defines a portion of the anolyte compartment, reducing the current density and maintaining such conditions for a period long enough to rejuvenate the membrane. Preferably, the anolyte pH is adjusted to lower than that at which the cell normally operates and to within the range 0.5 to 2.5, the caustic concentration in the compartment adjacent to the anolyte compartment is also reduced, as is the current density and these conditions are maintained for a sufficiently long time, usually ½ to 10 hours, to rejuvenate the membrane.

The invention will be readily understood by reference to the accompanying description of preferred embodiments thereof, taken in conjunction with the drawing in which.

Figure 1:
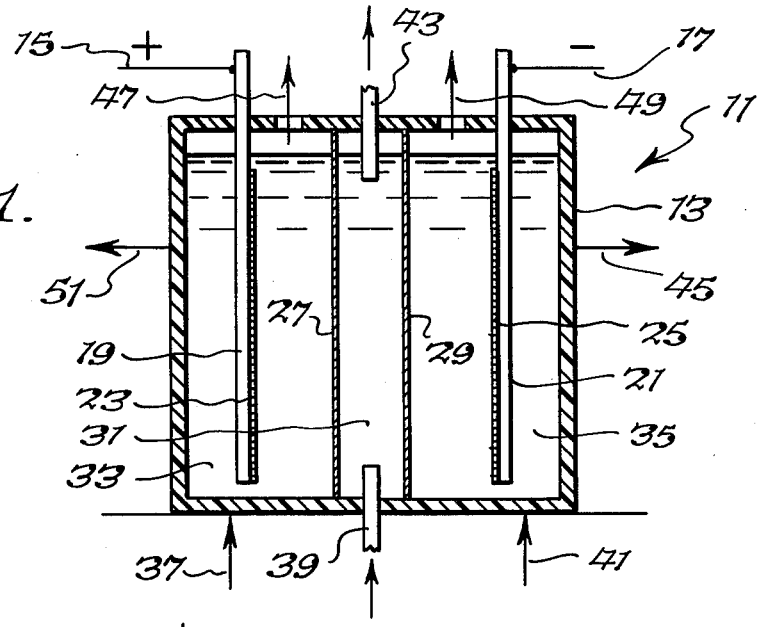
FIG. 1 is a sectional elevational view of a three compartment electrolytic cell in which the membrane between the anode and buffer compartments is being rejuvenated to decrease cell voltage.

Three compartment electrolytic cell 11 includes a housing or tank portion 13, sources of positive and negative electrical potentials 15 and 17, conductors 19 and 21, to conduct electricity to anode 23 and cathode 25, respectively and separating membranes 27 and 29, which define a buffer compartment 31 between anolyte or anode compartment 33 and catholyte or cathode compartment 35. Feed inlets 37, 39 and 41 are respectively for brine feed, water feed and water and/or weak caustic feed. Outlets 43 and 45 are for removal of buffer compartment liquid and caustic, respectively and gas outlets 47 and 49 are for taking off chlorine and hydrogen, respectively. Additionally, although not illustrated so as to maintain clarity of the drawing, various connections to facilitate recycling or recirculation of the various elctrolytes are often also present, as are means for maintaining circulation of the various electrolytes within the electrolyte compartments. External means for adding sodium chloride to depleted brine, which is shown being removed through exit line 51, are conventional and are not illustrated.

Figure 2:
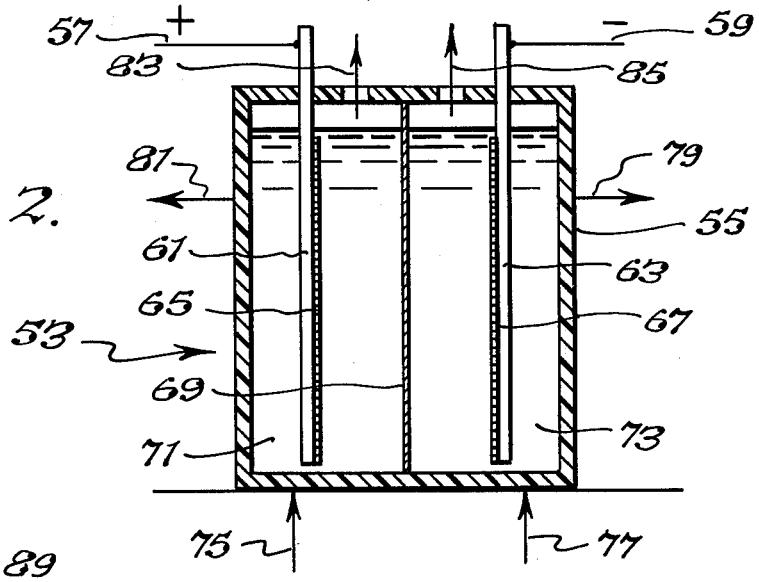
FIG. 2 is a similar view of a two compartment cell wherein the membrane is being rejuvenated.
Figure 3:
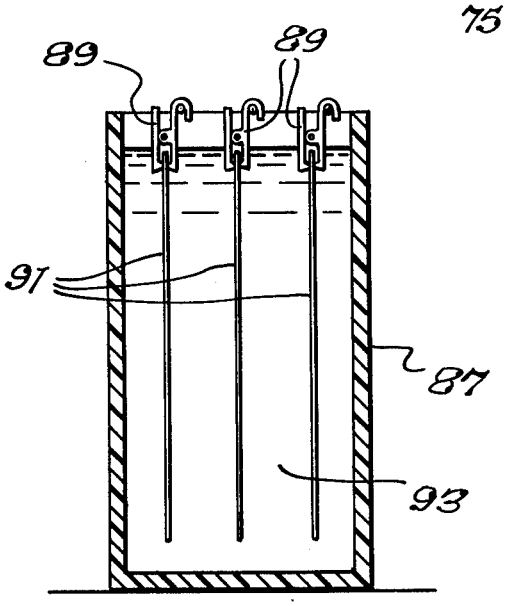
FIG. 3 is a sectional elevational view of a tank in which several membranes, having been withdrawn from electroltyic cells for rejuvenation, are being acid treated.

In FIG. 2 a two compartment cell corresponding in large part in its elements to the cell of FIG. 1, is shown. Two compartment cell 53 includes container or cell body 55, sources of positive and negative electric potential 57 and 59, conductor rods 61 and 63, anode 65 and cathode 67 and membrane 69, dividing the cell into anode or anolyte compartment 71 and cathode or catholyte compartment 73. The brine inlet 75 and water inlet 77, to the anode and cathode compartments, respectively, are illustrated at the bottom of the cell. Caustic solution takeoff 79 and depleted anolyte removal line 81 are shown at the top of the cell, as are chlorine and hydrogen outlets 83 and 85, respectively. In FIG. 3 tank 87 includes holding means 89 for supporting membranes 91 in rejuvenating acid 93.

In operation, when it is observed that voltage drop across the cell or across an assembly of such cells has increased to the extent of about 0.2 to 0.5 volt/cell above the initial drop noted at good start-up, it is an indication that the process of this invention should be effected. However, even before such a drop is noted, preventive action may desirably be taken. Thus, as a part of preventive maintenance, once every week, two weeks or month, it may be desirable to carry out the present process. The more frequently the preventive maintenance is applied the shorter may be the time periods for each of the operations. Normally, if the preventive maintenance procedure is not followed it will be desirable to rejuvenate the membranes every two to six months. To save unnecessary openings of the cells for rehabilitation an in situ treatment is preferred although, especially when the cell is being torn down for other reasons, removal of the membranes and soaking thereof in rejuvenating solution may be carried out.

To treat the membranes externally is a simple operation, requiring only the removal of the membrane from the cell and soaking it in an acidic solution, such as an aqueous solution of hydrochloric acid. Other acis may also be used, e.g., citric, acetic, sulfuric, phosphoric and gluconic acids and mixtures but HCl is far superior in the present applications. Nevertheless, despite the simplicity of the operation the electrolytic process has to be interrupted and the cell has to be torn down and subsequently reassembled. This usually makes the somewhat more complicated in situ operation preferable.

In the in situ rejuvenation of the membrane to lower the cell voltage the central consideration is that the membrane, on its anode side, should be treated with acid to remove hard deposits, sludge and other objectionable materials that may have partially inactivated it. Due to the nature of the deposit on the membrane and possibly extending into sub-surface portions thereof, the mere application of acid to the anode surface will not usually correct the situation. The deposit or sludge appears to be a complex mix of calcium, magnesium and sometimes, iron oxides, hydroxides, halides and complexes thereof which adhere to the anode surface (often ruthenium oxide on titanium). However it has been found that if the caustic concentration on the opposite side of the membrane, away from the anode, is diminished and if the current density is decreased (ranges of operative acidities, concentrations and current densities will be given later) the sludge or other coating is removed and the membrane is rejuvenated so that the voltage drop in the cell is appreciably decreased.

It will be seen that multi-compartment cells, having three, four or more compartments (but usually no more than four will be employed) will allow easier "cleaning" or rehabilitation of the membranes because the caustic concentration against the side of the membrane away from the anode will be lower in such cells. Thus, the rejuvenating acid will not be partially neutralized by undesired passage of some hydroxyl ions through the membrane into the anode compartment. This is so because normally the buffer compartments of such cells are intended to keep a lower hydroxyl content liquor near the anode-buffer membrane. The rejuvenation process times may be decreased when buffer compartments are employed. An additional advantage of the buffered membrane cells is in their lesser tendency to build up deposits of sludge. The deposits appear to be alkaline and therefore the less leakage of alkali into the anolye compartment the less chance there is for deposit of the alkaline sludge on the membrane. A considerable proportion is believed to derive from calcium and magnesium salts in the brine feed, which may contain 1 to 100,000 p.p.m. of such insoluble salt forming compounds, including iron compounds, as their oxides. Normally, good brine feed will contain less than 30 p.p.m. of such salts, e.g., 3 to 30 p.p.m., but this amount can still cause membrane problems.

During the rejuvenation operation the current flow will be diminished so as to produce lesser quantities of caustic solution and thereby facilitate the acidification. Such lowering of the current density produces greatly diminished quantities of chlorine and caustic and therefore cuts into cell capacity. With a three or four compartment cell the buffer compartment electrolyte can be diluted while the catholyte is still maintained fairly concentrated and the dilute buffer solution produced can be circulated to the catholyte for further upgrading or "concentrating". For this reason the present rejuvenation method is preferably carried out in a three compartment cell for best results, although because two compartment cells are more commercial it may be that most of the time the process will have to be effected in such cells.

To lower the caustic concentration adjacent the membrane to be treated is a simple matter, requiring only the cutting down of the current flow through the cell and diluting of the catholyte or buffer elctrolyte with water. After experience with a particular cell design and membrane it will be known for how long the rejuvenation process should be carried out to drop the cell voltage to a desirable extent. Normally, however, the time taken is from one half hour to one day, usually from ½ to 10 hours, preferably ½ to 1 hour. The pH will be lowered to from 0 to 3, with 0.5 to 2.5 being a normally employed range and with a pH of about 1 to 2 or 2.5 being preferred. The pH will normally be lower than that of the electrolyte during normal use and said electrolyte pH is usually from 3 to 5, preferably from 3 to 4. The normal caustic concentration in the buffer zone of the three compartment cell will be about 50 grams per liter and in the catholyte compartment of a two compartment cell it will be about 150 g./l. (it will also be about 150 g./1. in the catholyte compartment of the three compartment cell). Desirably, such concentration is decreased, preferably to less than half, with respect to the higher caustic contents and to less than three-fourths with respect to the lower contents. Thus, if the catholyte concentration is 150 g./l. of sodium hydroxide it will be desirable to lower this below 75 g./l. where if the buffer compartment concentration is 50 g/l. it need only be lowered to less than 38 g./l., e.g., 20 to 35 g./l. A preferred range of reduced caustic concentrations is 20 to 45 g./l. The current density, normally 0.2 to 0.5 ampere/sq. cm., is usually reduced to about 0.01 to 0.1, preferably .01 to .05 and most preferably about 0.01 ampere/sq. cm. during the period of the treatment.

As a result of the rejuvenation when the cell is returned to regular operation the voltage will usually be 3.5 to 4.5, which usually is 0.2 to about 0.5 volt lower than that required to maintain the operating current density before. The electrolysis will usually be resumed at an anolyte pH of about 3 to 4, e.g., 4, with a buffer compartment caustic concentration of about 50 to 100 g./l., and a current density of about 0.1 to 0.5 ampere/sq. cm., e.g., 0.3 ampere/sq. cm. For the two compartment cell the caustic concentration may be 100 to 160 g./l., with the current density, voltage drop and anolyte pH being the same as for the three compartment cell already described.

The preferred acid employed for the acidification, aqueous hydrochloric acid, may be concentrated or slightly diluted, so that its pH is usually about 0 or less, so that it can satisfactorily acidify the anolyte. The quantity employed will be such as to produce the desired pH in the anolyte. To avoid any possible damage to the membrane it is preferred to have the acid completely mixed in with the anolyte before entrance into the cell. Therefore, it is usually preferred to admix the acid with the electrolyte externally of the cell after addition of salt to depleted brine removed from the cell and returned to it as feed. The normal concentration of the brine is about 25% sodium chloride, with 21 to 23% being about the concentration in the depleted brine. Thus, 2 to 4% of sodium chloride is usually added plus sufficient hydrochloric acid to change the anolyte pH to the desired acidity. Hydrochloric acid is preferred because it leaves no useless residue in the anolyte, the chloride ion being converted to chlorine, which is recovered as a valuable product. In some cases it may be desirable to add other agents with the hydrochloric acid, e.g., sequestrants, but normally this will neither be necessary nor desirable.

Operating temperatures during acidification and other rehabilitation treatments may be maintained in the usual range of 65° to 95° C., preferably about 80° to 92° C. While the anolyte may contain such proportions of calcium and magnesium salts as produce the undesired sludge or coating on the membrane, e.g., 1 to 8%, as calcium and magnesium compounds, it is preferred that the proportions of these materials be severely limited and if possible, be held to less than 0.1% or 1%. Because this is not always possible the present method is of importance. Even when the proportion of alkaline earth metal and magnesium salts which are sludge-formers is kept low, such as below 1%, there will still be a buildup of such a sludge or coating on and/or in the membrane, requiring rejuvenation by this method, although more time may elapse between treatments. In those cases wherein the magnesium and calcium salt contents are above 1% there is a real need for periodic rejuvenation of the membrane(s) by the present method to avoid costly waste of power.

When, instead of utilizing the in situ treatment, the membranes are acid treated externally of the electrolytic cell care should be taken to prevent the membranes from drying out while still held in position on the cell body or frame since this can cause excessive shrinkage and rupture of the membrane, despite the use of backing screens of polytetrafluoroethylene or other structures to improve the membrane strength. If it is apparent that the membranes are going to dry out it is suggested that they be treated first with a suitable solvent or solvent system, such as glycerol in brine to prevent excess shrinkage before acidification. The acidification treatment may be effected while the membranes are still held in place on cell body parts but normally they will be removed and a plurality of them will be treated in a single vessel. Agitation may be employed to aid in removing the sludge or coating from the membranes. Ultrasonic mixing, ordinary stirring and agitation by recirculation of the liquid medium are all practicable. In both the in situ and tank rejuvenation processes any sludge forming at the bottom of the cell or tank may then be withdrawn to remove calcium and magnesium compounds and when these are dissolved in the acidic anolyte they may be recovered and removed from it by neutralization processes. Otherwise, it is possible that if the magnesium and/or calcium compounds remain in the anolyte they could again deposit on the membrane and adversely affect its conductivity.

The presently preferred cation permselective membrane is of a hydrolyzed copolymer of perfluorinated hydrocarbon and a fluorosulfonated perfluorovinyl ether. The perfluorinated hydrocarbon is preferably tetrafluoroethylene, although other perfluorinated and saturated and unsaturated hydrocarbons of 2 L to 5 carbon atoms may also be utilized, of which the monoolefinic hydrocarbons are preferred, especially those of 2 to 4 carbon atoms and most especially those of 2 to 3 carbon atoms, e.g., tetrafluoroethylene, hexafluoropropylene. The sulfonated perfluorovinyl ether which is most useful is that of the formula $FSO_2CF_2CF_2OCF(CF_3)CF_2OCF=CF2$. Such a material, named as perfluoro[2-(2-fluorosulfonylethoxy)-propyl vinyl ether], referred to henceforth as PSEPVE, may be modified to equivalent monomers, as by modifying the internal perfluorosulfonylethoxy component to the corresponding propoxy component and by altering the propyl to ethyl or butyl, plus rearranging positions of substitution of the sulfonyl thereon and utilizing isomers of the perfluoro-lower alkyl groups, respectively. However, it is most preferred to employ PSEPVE.

The method of manufacture of the hydrolyzed copolymer is described in Example XVII of U.S. Pat. No. 3,282,865 and an alternative method is mentioned in Canadian Pat. No. 849,670, which also discloses the use of the finished membrane in fuel cells, characterized therein as electrochemical cells. The disclosures of such patents are hereby incorporated herein by reference. In short, the copolymer may be made by reacting PSEPVE or equivalent with tetrafluoroethylene or equivalent in desired proportions in water at elevated temperature and pressure for over an hour, after which time the mix is cooled. It separates into a lower perfluoroether layer and an upper layer of aqueous medium with dispersed desired polymer. The molecular weight is indeterminate but the equivalent weight is about 900 to 1,600 preferably 1,100 to 1,400 and the percentage of PSEPVE or corresponding compound is about 10 to 30%, preferably 15 to 20% and most preferably about 17%. The unhydrolyzed copolymer may be compression molded at high temperature and pressure to produce sheets or membranes, which may vary in thickness from 0.02 to 0.5 mm. These are then further treated to hydrolyze pendant $—SO_2F$ groups to $—SO_3H$ groups, as by treating with 10% sulfuric acid or by the methods of the patents previously mentioned. The presence of the $—SO_3H$ groups may be verified by titration, as described in the Canadian patent. Additional details of various processing steps are described in Canadian Pat. No. 752,427 and U.S. Pat. No. 3,041,317, also hereby incorporated by reference.

Because it has been found that some expansion accompanies hydrolysis of the copolymer it is often preferred to position the copolymer membrane after hydrolysis onto a frame or other support which will hold it in place in the electrolytic cell. Then it may be clamped or cemented in place and will be true, without sags. The membrane is preferably joined to the backing tetrafluoroethylene or other suitable filaments prior to hydrolysis, when it is still thermoplastic, and the film of copolymer covers each filament, penetrating into the spaces between them and even around behind them, thinning the films slightly in the process, where they cover the filaments.

The membrane described is far superior in the present processes to all other previously suggested membrane materials. It is more stable at elevated temperatures, e.g., above 75° C. It lasts for much longer time periods in the medium of the electrolyte and the caustic product and does not become brittle when subjected to chlorine at high cell temperatures. Considering the savings in time and fabrication costs, the present membranes are more economical. The voltage drop through the membranes is acceptable and does not become inordinately high, as it does with many other membrane materials, when the caustic concentration in the cathode compartment increases to above about 200 g./l. of caustic. The selectivity of the membrane and its compatibility with the electrolyte do not decrease detrimentally as the hydroxyl concentration in the catholyte liquor increases, as has been noted with other membrane materials. Furthermore, the caustic efficiency of the electrolysis does not diminish as significantly as it does with other membranes when the hydroxyl ion concentration in the catholyte increases. While the more preferred copolymers are those having equivalent weights of 900 to 1,600, with 1,100 to 1,400 being most preferred, some useful resinous membranes produced by the present method may be of equivalent weights from 500 to 4,000. The medium equivalent weight polymers are preferred because they are of satisfactory strength and stability, enable better selective ion exchange to take place and are of lower internal resistances, all of which are important to the present electrochemical cells.

Improved versions of the above-described copolymers may be made by chemical treatment of surfaces thereof, as by treatments to modify the $—SO_3H$ group thereon. For example, the sulfonic group may be altered on the membrane to produce a concentration gradient or may be replaced in part with a phosphoric or phosphonic moiety. Such changes may be made in the manufacturing process or after production of the membrane. When effected as a subsequent surface treatment of a membrane the depth of treatment will usually be from 0.001 to 0.01 mm. In some instances it may be desirable to convert the sufonyl or sulfonic acid group of the membrane on one side (usually the anode side) to a sulfonamide, which is more hydrophilic, which may be effected in the manner described in U.S. Pat. No. 3,784,399, hereby incorporated by reference. Also, the membrane may be in laminated form, which is now most preferred, with the laminae being of a thickness in the range of 0.07 to 0.17 mm. on the anode side and 0.01 to 0.07 mm. on the cathode side, which laminae are respectively, of equivalent weights in the ranges of 1,000 to 1,200 and 1,350 to 1,600. A preferred thickness for the anode side lamina is in the range of 0.07 to 0.12 mm. thick and most preferably this is about 0.1 mm., with the preferred thickness of the lamina on the cathode side being 0.02 to 0.07 mm., most preferably about 0.05 mm. The preferred and most preferred equivalent weights are 1,050 to 1,150 and 1,100 and 1,450 to 1,550 and 1,500, respectively. The higher the equivalent weight of the individual lamina the lesser the thickness preferred to be used, within the ranges given.

In addition to the copolymers previously discussed, including modifications thereof, it has been found that another type of membrane material is also superior to prior art films for applications in the present processes. Although it appears that tetrafluoroethylene (TFE) polymers which are sequentially styrenated and sulfonated are not useful for making satisfactory cation-active permselective membranes for use in the present electrolytic processes it has been established that perfluorinated ethylene propylene polymer (FEP) which is styrenated and sulfonated makes a useful membrane. The sulfostyrenated FEP's are surprisingly resistant to hardening and otherwise failing in use under the present process conditions.

To manufacture the sulfostyrenated FEP membranes a standard FEP, such as manufactured by E. I. DuPont de Nemours & Co., Inc., is styrenated and the styrenated polymer is then sulfonated. A solution of styrene in methylene chloride or benzene at a suitable concentration in the range of about 10 to 20% is prepared and a sheet of FEP polymer having a thickness of about 0.02 to 0.5 mm., preferably 0.05 to 0.15 mm., is dipped into the solution. After removal it is subjected to radiation treatment, using a cobalt$^{60}$ radiation source. The rate of application may be in the range of about 8,000 rads/hr. and a total radiation application is about 0.9 megarads. After rinsing with water the phenyl rings of the styrene portion of the polymer are monosulfonated, preferably in the para position, by treatment with chlorosulfonic acid, fuming sulfuric acid or $SO_3$. Preferably, chlorosulfonic acid in chloroform is utilized and the sulfonation is completed in about ½ hour.

Examples of useful membranes made by the described process are products of RAI Research Corporation, Hauppauge, New York, identified as 18ST12S, and 16ST13S, the former being 18% styrenated and having two-thirds of the phenyl groups monosulfonated and the latter being 16% styrenated and having thirteenth-sixteenths of the phenyl groups monosulfonated. To obtain 18% styrenation a solution of 17-½% of styrene in methylene chloride is utilized and to obtain the 16% styrenation a solution of 16% styrene in methylene chloride is employed.

The products resulting compare favorably with the preferred copolymers previously described, giving voltage drops of about 0.2 volt each in the present cells at a current density of 0.3 ampere/sq. cm., the same as is obtained from the copolymer.

The membrane walls will normally be from 0.02 to 0.5 mm. thick, preferably from 0.07 to 0.4 mm. and most preferably 0.1 to 0.2 mm. Ranges of thicknesses for the portions of the laminated membranes previously described have already been given. When mounted on a polytetrafluoroethylene, asbestos, titanium or other suitable network, for support, the network filaments or fibers will usually have a thickness of 0.01 to 0.5 mm., preferably 0.05 to 0.15 mm., corresponding to up to the thickness of the membrane. Often it will be preferable for the fibers to be less than half the film thickness but filament thicknesses greater than that of the film may also be successfully employed, e.g., 1.1 to 5 times the film thickness. The networks, screens or cloths have an area percentage of openings therein from about 8 to 80%, preferably 10 to 70% and most preferably 30 to 70%. Generally the cross sections of the filaments will be circular but other shapes, such as ellipses, squares and rectangles, are also useful. The supporting network is preferably a screen or cloth and although it may be cemented to the membrane it is preferred that it be fused to it by high temperature, high pressure compression before hydrolysis of the copolymer. Then, the membrane-network composite can be clamped or otherwise fastened in place in a holder or support.

The material of construction of the cell body may be conventional, including concrete or stressed concrete lined with mastics, rubbers, e.g., neoprene, polyvinylidene chloride, FEP, chlorendic acid based polyester, polypropylene, polyvinyl chloride, TFE or other suitable plastic or may be similarly lined boxes of other structural materials. Substantially self-supporting structures, such as rigid polyvinyl chloride, polyvinylidene chloride, polypropylene or phenol formaldehyde resins may be employed, preferably reinforced with molded-in fibers, cloths or webs of glass filaments, steel, nylon, etc. The preferred embodiments of the cells, whether monopolar or bipolar, are made of an electrolyte-resistant polymeric material such as molded polypropylene, preferably reinforced with asbestos, mica or calcium silicate fibers or platelets.

The anodes employed are of a suitable material having openings therein through which any chlorine produced during electrolysis may escape. The active surface materials of the anodes may be noble metals, noble metal alloys, noble metal oxides, noble metal oxides mixed with valve metal oxides, e.g., ruthenium oxide plus titanium dioxide, or mixtures thereof, normally on a substrate which is sufficiently conductive for the electrolytic operation. Preferably, such surfaces are on an electrolyte-resistant valve metal, such as titanium and connect through it to a conductor of a metal such as copper, silver, aluminum, steel or iron, which is normally clad, plated or otherwise protected with a covering of similar electrolyte-resistant material. It is especially desirable that the openwork portion of the electrodes, excluding the conductors, be of titanium, activated on a surface thereof or entirely (for generation of chlorine on such surface) with a noble metal or noble metal oxide, such as ruthenium oxide, platinum oxide, ruthenium or platinum. Instead of titanium, another useful valve metal is tantalum. The anode is usually of an expanded titanium mesh coated on a surface thereof with ruthenium oxide. In all cases, the conductive material of the conductor is preferably copper, clad with titanium.

The cathodes utilized may be of any electrically conductive material which will resist the attack of the various cell contents. The cathodes are preferably made of steel mesh, joined to a copper conductor but other cathode materials and conductive materials may also be utilized, among which, for the cathode, are iron, graphite, lead dioxide on graphite, lead dioxide on titanium, or noble metals, such as platinum, iridium, ruthenium or rhodium. When using the noble metals they may be deposited as surfaces on condutive substrates, such as those of copper, silver, aluminum, steel or iron. The cathodes will preferably be of screen or expanded metal mesh and, like the anodes, will be flat or of other conforming shapes so that the inter-electrode distances will be approximately the samethroughout.

The following examples are given to illustrate but not limit the invention. Unless otherwise indicated, all parts are by weight and all temperatures are in °C.

EXAMPLE 1

In a three compartment membrane cell of the type illustrated in FIG. 1 continued operation of the cell results in the precipitation on the surface of the cation-active permselective membrane adjacent the anolyte compartment and apparently also in the interior thereof of calcium, magnesium, iron and other metal salts, apparently including oxides, hydroxides, complexes and other insoluble salts. Also, there may be a reaction of such salts with the cation-active sites on the membranes. It is noted that after several months of use of the cell to produce chlorine, caustic and hydrogen, the voltage drop across the cell increases by about 0.3 volt, to about 4.4 volts instead of 4.1 volts, as it is with a new membrane.

The membrane employed in the cell is a hydrolyzed copolymer of a perfluorinated hydrocarbon and a fluorosulfonated perfluorovinyl ether in laminated form, having a lamina of a thickness of about 0.1 mm. on the side nearer to the cathode and 0.05 mm. on the side facing the anode. Such arrangement is the same for both membranes. The copolymers of the membrane are made by reacting PSEPVE with tetrafluoroethylene to produce polymers of different molecular weights, each containing about 17% of PSEPVE. Such polymers, having equivalent weights of 1,100 and 1,500, respectively, for the thicker and thinner laminae, are hydrolyzed to convert the pendant $—SO_2F$ groups thereof to $—SO_3H$ groups, in accordance with the method described in the preceding specification.

The anode is of ruthenium oxide on expanded titanium mesh and the cathode is a soft steel screen. Conductors are titanium clad copper and copper rods respectively, and carry the electricity from a source thereof or from an external connector to the electrodes. The cell body is of molded polypropylene reinforced with asbestos and mica flakes. The cell is part of a cell assembly, not illustrated, in which it is incorporated in external bipolar connecting relationship.

Operating conditions are 85 to 90° C., 4.1 volts at start-up (4.4 volts after fouling of the membrane), 0.3 ampere/sq. cm., producing 150 g./l. sodium hydroxide solution in the catholyte and 50 g./l. sodium hydroxide solution in the buffer compartment, with a feed of 25% sodium chloride content and 15 p.p.m. of mixed salts of calcium, magnesium and iron as oxides (in proportions of about 3:1.3:0.7). The salts are present mostly as the chlorides, and sulfates although some are oxides and hydroxides, e.g., 30% chlorides, 60% sulfates and 10% oxides and hydroxides.

During continuous operation of the cell over a period of about a month, apparently due to some back migration of hydroxyl ion through the membrane the surface and a portion of the interior thereof becomes fouled with insoluble precipitated or adherent material and it is noted that the voltage drop across the cell increases to 4.4 volts. To lower the voltage drop concentrated hydrochloric acid is added to the feed inlet before the cell is sufficient quantity to change the anolyte pH to 2.5. At the same time, the current flow to the group of cells is cut, from 60 kiloamperes to 10 kiloamperes or to a current density of about 0.05 ampere/sq. cm. and more water is fed to the buffer compartment so as to lower the caustic concentration therein to 32 g./l. of sodium hydroxide. The cell is operated for seven hours under these conditions and at the end of this time a voltage decrease (0.3 volt) results, with the cell operating at 4.1 volts under normal conditions.

It is considered that by reducing the current to a low value the desirable effect of diluting the buffer compartment caustic to reduce hydroxyl transfer to the anolyte side of the membrane is further aided and a natural back flushing occurs due to osmosis. Also, the continued production of chlorine at the anode helps to maintain circulation of the anolyte, which can also be aided by mechanical or pumping means, and thereby assists in removing material from the membrane once it has been loosened.

After completion of the rejuvenation treatment the anolyte is removed from the cell, replaced with new anolyte, conditions are returned to normal and production of chlorine and caustic is continued. However, periodically thereafter, such as every week, the cell is operated for an hour under the described experimental conditions to inhibit the fouling of the membrane. After completions of the seven hour and one hour treatments the cell may continue to be operated with the acidified anolyte and eventually, in due course, such acidity will be diminished and the pH will be raised to normal operating pH (3 to 4).

EXAMPLE 2

Instead of treating the membranes in situ, as in Example 1, several anode compartment membranes are removed from cells when they become fouled like the anode membrane of Example 1 and are immersed in an aqueous solution of hydrochloric acid at room temperature for times up to 10 hours. During the immersions the solution is kept in gentle motion by a recirculating pump, not illustrated in the drawing. After six to eight hours the membranes are sufficiently rejuvenated so as to be returnable to the cells from which they were withdrawn. Such cells then operate at a lower voltage, usually being 0.1 to 0.5 volt lower than that obtaining at the halting of the cell operation and removal of the membranes.

In some variations of this example the membranes are maintained in the frames or holders when subjected to the external acidification treatment and in others they are first removed from the frames or holders. In both cases satisfactory rejuvenation results when the treatment pH is 0.5 to 2.5, e.g., 1.5.

EXAMPLE 3

The experiment of Example 1 is repeated, using the two compartment cell of FIG. 2. The various cell parts are the same as corresponding parts described in Example 1 but operation of the cell is at a catholyte caustic concentration of 130 to 200 g./l., averaging about 160 g./l. sodium hydroxide. The in situ treatment effected is the same as that of Example 1 and after seven hours the membrane is rejuvenated.

In variations of the above examples the anolyte pH's produced, the current densities employed and the concentration of sodium hydroxide in the other (non-anolyte) compartment adjacent to the anolyte are varied within the ranges given in the preceding specification and useful rejuvenation is obtained within the time limits cited. For example, the anolyte pH's employed may be 1.5, 1.8, 2.2 and 2.5, the current densities may be 0.02, 0.04 and 0.1 ampere/sq. cm., the caustic concentrations may be 25, 45, or, with the two compartment cell, 75 g./l. and the times of treatment may be one hour, three hours or ten hours. Similarly, the material of the membrane may be changed to a 0.3 mm. thick sulfostyrenated FEP membrane of the RAI Research Corportion 18ST12S and 16ST13S types and good rejuvenation is obtainable. If desired, external acidification of the "catholyte" membranes of the three compartment cells may be effected but usually this is not necessary for the efficient operation of the cell. Also, in the above examples the sludge removed from the membranes is filtered out so to prevent it from being subsequently redeposited. In those cases wherein it has become completely dissolved, it is externally neutralized, as by treatment with sodium hydroxide, to produce a sufficiently neutral or alkaline pH so as to precipitate out. However, even when such separation is not effected the voltage characteristics of the cell are improved by the described treatments.

The invention has been described with respect to illustrations and examples thereof but is not to be limited to these because it is evident that one of skill in the art, with the present specification before him, will be able to utilize substitutes and equivalents without departing from the spirit of the invention.

What is claimed is:

1. In the electrolysis of brine in a membrane cell, the improvement which comprises lowering the voltage drop across the cell by dissolving deposits upon the membrane by increasing the acidity of the anolyte, diluting the electrolyte located immediately adjacent to said anolyte and separated from said anolyte by a membrane, reducing the current density, and maintaining such conditions during electrolysis for a period sufficiently long to rejuvenate said membrane.

2. A method according to claim 1 wherein the acid employed is hydrochloric acid, the anolyte pH is adjusted with the acid to a pH in the range of about 0.5 to 2.5 from a higher pH, the acustic concentration in the compartment immediately adjacent to the anolyte compartment is reduced to about 20 to 45 grams per liter, the current density is reduced to about 0.01 to 0.1 ampere per square centimeter, such conditions are maintained for a period of ½ to 10 hours and the membrane is a cation-active permselective membrane of a polymeric material selected from the group consisting of a hydrolyzed copolymer of a perfluorinated hydrocarbon and a fluorosulfonated perfluorovinyl ether, and a sulfostyrenated perfluorinated ethylene propylene polymer.

3. A process according to claim 2 wherein the cell is a three compartment cell, the membrane is a hydrolyzed copolymer of tetrafluoroethylene and a fluorosulfonated fluorovinyl ether of the formula $FSO_2CF_2CF_2OCF(CF_3)CF_2OCF{=}CF_2$, which copolymer has an equivalent weight of about 900 to 1,600, the anolyte is acidified with hydrochloric acid to a pH of 1 to 2, the buffer compartment electrolyte sodium hydroxide concentration is lowered to 20 to 35 grams per liter and the current density is increased to 0.01 to 0.05 ampere/sq. cm. for ½ to 1 hour, after which electrolysis is resumed at an anolyte pH of about 4, a buffer compartment caustic concentration of about 50 to 100 grams per liter, a current density of about 0.3 ampere/sq. cm. and a voltage of 3.5 to 4.5, which voltage is 0.2 to about 0.5 volt lower than that required to maintain said current density before the rejuvenation treatment.

4. A process according to claim 2 wherein the cell is a two compartment cell, the membrane is a hydolyzed copolymer of tetrafluoroethylene and a fluorosulfonated fluorovinyl ether of the formula $FSO_2CF_2CF_2OCF(CF_3)CF_2OCF{=}CF_2$, which copolymer has an equivalent weight of about 900 to 1,600, the anolyte is acidified with hydrochloric acid to a pH of 1 to 2, the catholyte sodium hydroxide concentration is lowered to 20 to 45 grams per liter and the current density is decreased to 0.01 to 0.05 ampere/sq. cm. for ½ to 1 hour, after which the electrolysis is resumed at an anolyte pH of about 4, a catholyte compartment caustic concentration of 130 to 200 g./l., a current density of about 0.3 ampere/sq. cm. and a voltage of 3.5 to 4.5, which voltage is 0.2 to about 0.5 volt lower than that required to maintain such current density before the rejuvenation treatment.

5. A process according to claim 3 wherein the lowering of the buffer compartment pH is effected by a combination of water dilution and decrease in current density.

6. A process according to claim 4 wherein the lowering of the pH of the catholyte compartment is effected by a combination of water dilution and decrease in current density.

7. A method according to claim 1 wherein a brine is fed to the anolyte compartment which contains from 3 to 30 p.p.m. of calcium and/or magnesium sludge as the oxide(s).

8. A method according to claim 3 wherein a brine is fed to the anolyte compartment which contains from 3 to 30 p.p.m. calcium and/or magnesium sludge as the oxide(s).

9. A method according to claim 4 wherein a brine is fed to the anolyte compartment which contains from 3 to 30 p.p.m. of calcium and/or magnesium sludge as the oxide(s).

* * * * *

UNITED STATES PATENT OFFICE

CERTIFICATE OF CORRECTION

Patent No. 4,040,919 Dated August 9, 1977

Inventor(s) Jeffrey D. Eng

It is certified that error appears in the above-identified patent and that said Letters Patent are hereby corrected as shown below:

Column 5, line 54, "2L to 5" should read -- 2 to 5 --.
Column 7, line 18, "sufonyl" should read -- sulfonyl --.
Column 12, line 2, Claim 2, "acustic" should read -- caustic --.
Column 12, line 22, Claim 3, "increased" should read -- decreased --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*